United States Patent [19]

Berkan

[11] Patent Number: 4,565,323

[45] Date of Patent: Jan. 21, 1986

[54] SPRINKLER SYSTEMS

[75] Inventor: Ronald R. Berkan, Sacramento, Calif.

[73] Assignee: Action Pact, Inc., Sacramento, Calif.

[21] Appl. No.: 490,325

[22] Filed: May 2, 1983

[51] Int. Cl.[4] ..... B05B 3/14

[52] U.S. Cl. ..... 239/230; 239/233; 239/DIG. 1

[58] Field of Search ..... 239/230–233, 239/500, 505, 507, 509, 511, 521, 522, 499, 504, 170, DIG. 1

[56] References Cited

U.S. PATENT DOCUMENTS

| | | | |
|---|---|---|---|
| 1,843,759 | 2/1932 | Chipman | 239/170 |
| 3,831,853 | 8/1974 | Drori | 239/230 |
| 3,952,953 | 4/1976 | Eby | 239/230 |
| 4,182,494 | 1/1980 | Wichman et al. | 239/230 |
| 4,330,087 | 5/1982 | Wood et al. | 239/233 |

*Primary Examiner*—Jeffrey V. Nase
*Assistant Examiner*—James R. Moon, Jr.
*Attorney, Agent, or Firm*—Mark C. Jacobs

[57] ABSTRACT

Improvements in an oscillating sprinkler having an improved discharge of fluid wherein the fluid being discharged enters two side by side curved chambers and is split into two separate streams. The spring controlling the oscillation of the sprinkler is centered on the impact arm of the sprinkler by a spring retainer and a boss on the arm itself so as to provide a smooth transition for the water and disperse it evenly with less operating pressure. The arm may have a removable reactor spoon portion so that the spoon portion can be quickly and easily replaced, if desired.

12 Claims, 12 Drawing Figures

SPRINKLER SYSTEMS

BACKGROUND OF THE INVENTION

1. Field of the Invention

The invention relates to sprinklers; and, more particularly, to improvements in the reactor portion of the impact arm and spring controlling the discharge of water and oscillation of the sprinkler.

2. Description of the Prior Art

Oscillating sprinklers are well known in the prior art. Two such sprinklers are described in U.S. Pat. Nos. 3,977,610 and 4,182,494 to Royer et al and Wichman et al, respectively. These prior art sprinklers require a substantial amount of water pressure to operate efficiently and, even at that, do not disperse the water flow evenly. Further, should the fluid dispersing reaction head become clogged, damaged or worn, it could not be easily replaced.

There is thus a need for a sprinkler head which disperses the water in an even water stream, does not require a significantly great amount of water pressure to operate and has reaction heads which can be quickly and easily replaced.

SUMMARY OF THE INVENTION

It is an object of this invention to provide a sprinkler head having improved water dispersement.

It is another object of this invention to provide such a sprinkler head which can disperse water evenly with substantially less water pressure than prior art devices.

It is still another object of this invention to provide a sprinkler head having an arm with a removable reaction head so that it can be easily replaced if clogged, broken or worn.

These and other objects are preferably accomplished by providing an oscillating sprinkler having an improved discharge of fluid wherein the fluid being discharged enters two side by side curved chambers and is split into two separate streams. The spring controlling the oscillation of the sprinkler is centered on the impact arm of the sprinkler by a spring retainer and a boss on the arm itself so as to provide a smooth transition for the water and disperse it evenly with less operating pressure. The arm may have a removable reactor spoon portion so that the spoon portion can be quickly and easily replaced, if desired.

DESCRIPTION OF THE PREFERRED EMBODIMENT

Figure 1:
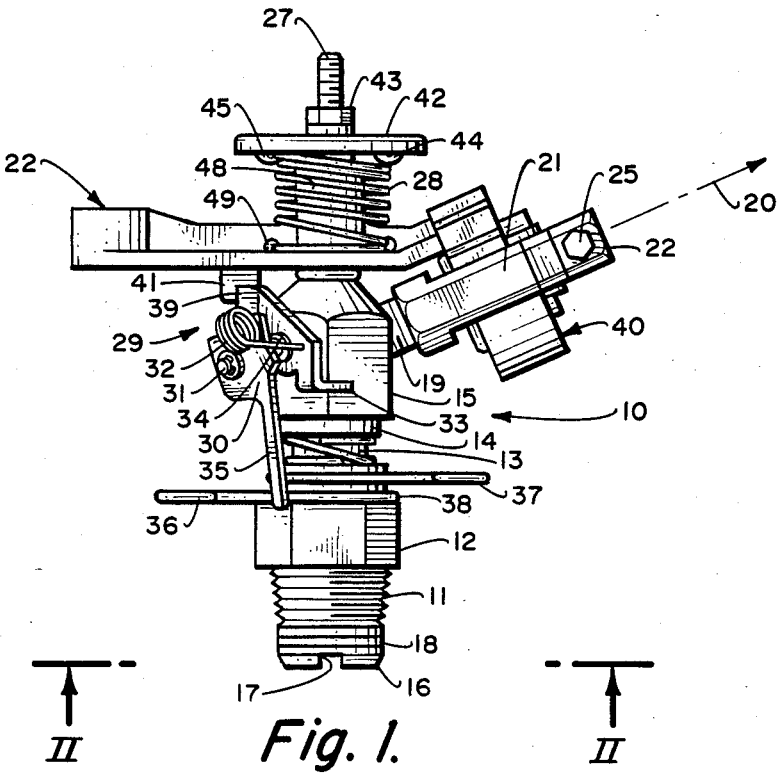
FIG. 1 is a vertical view of a sprinkler head in accordance with the invention.
Figure 2:
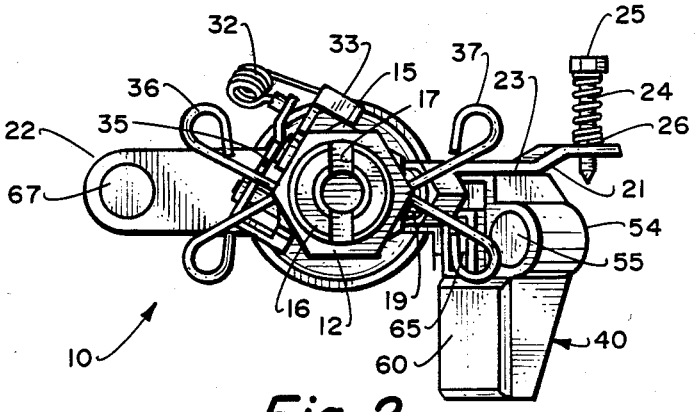
FIG. 2 is a view taken along lines II—II of FIG. 1.

Referring now to FIG. 1 of the drawing, a sprinkler head 10 is shown mounted for pop-up operation having a lower threaded end 11 for threading the head 10 to a conventional riser (not shown) or other subterranean housing means as is well known in the sprinkler art. End 11 has a hexagonal shaped integral bearing portion 12 so that head 10 may be quickly and easily attached to or removed from the riser. A tubular stem 13 is internally mounted in end 11 and extends upwardly into sprinkler body 14 such as is well known in the art. Body 14 also has an integral hexagonally shaped wrench head portion 15 for engagement by a tool or the like to separate the parts. The internal configuration of the head 10 of FIG. 1 is old and well known in the art and forms no part of this invention. Such a configuration is disclosed in U.S. Pat. No. 4,182,494 to Wichman et al. Sprinkler head 10 has an enlarged head 16 at the bottom and a diametric tool slot 17. A friction sealing washer 18 is provided between head 16 and end 11 of the bearing portion 12. The end of stem 13 in body portion 15 (not visible) is an opposite screw thread. A nozzle 19 having a predetermined and normally upwardly directed discharge axis 20 in fluid communication with stem 13 is mounted on body portion 14, which can be at any practical angle for either throwing water upward or downward depending on the positioning and application of head. Integral with nozzle 19 is an arm 22 (see also FIG. 2) extending alongside of axis 20 and providing a stop 21 where it abuts against the lever arm 23. A dispersing screw 24 in mounted on arm 22 for adjusting positioning of arm 22 toward the axis 20. Ase seen in FIG. 2, screw 24 cannot engage arm 22; however, longer arms 22 may be selectively mounted to body 14 as is well known in the art thus allowing adjustment as is also well known in the sprinkler art. The screw 24 thus includes a head 25 (FIG. 1) and a spring 26 under compression between the head and arm to resist inadventent maladjustment of screw 24.

Lever arm 23 is preferably a weighted impact lever mounted for reciprocal pivotal movement about a pivot pin 27 on the body 14 coaxial with respect to stem 13. A helical spring 28 is mounted about the fulcrum pin 27 and interconnects the impact lever arm 23 and the body 14 resiliently to urge the impact lever arm 23 against the primary stop 21. As is well known in the art, when fluid is emitted from nozzle 19, it strikes arm 23, drives arm 23 away from the stream in opposition to spring 28, and is subsequently returned to the stream by energy stored in spring 28. This results in periodic impacting of the arm 23 against stop 21 to rotate the sprinkler in increments of stepped progression in a clockwise direction as viewed in FIG. 2. However when the sprinkler is rotated to a desired limit as on a part circle as $\frac{3}{4}$, in the clockwise direction, it is desirable to reverse the sprinkler and cause it to rotate in a counterclockwise direction, as viewed in FIG. 2, until it reaches a predetermined limit in that direction of rotation. To achieve this, a well known form of reversing control system indicated generally at 29 is utilized.

Figure 3:
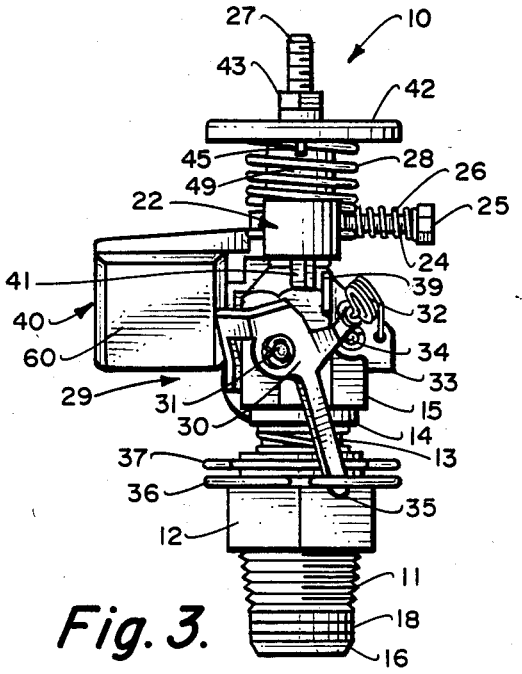
FIG. 3 is a vertical view similar to FIG. 1 of another side of the head of FIG. 1.

System 29 includes a trip arm 30 (FIG. 3) pivotally mounted to body 14 by a pivot pin 31 and coupled by an overcenter spring 32 to a reversing arm 33 (see also FIG. 1) also pivotally mounted to body 14 by a pivot pin 34. The trip arm 30 and reversing arm 33 are coupled together in such a manner that the trip arm 30 and reversing arm 33 are each movable between two stable positions, and the spring acts to hold the trip arm 30 and reversing arm 33 in one or the other of their two stable positions.

Movement of the trip arm 30 and reversing arm 33 between their stable positions is effected by means of a trip extension 35 which depends downwardly from the trip arm 30 to engage adjustable trip stops 36 and 37 provided by looped ends of spring 38 encircling sprinkler head 10 between body 14 and hex portion 12. The reversing arm 33 has an upwardly projecting hooked end portion 39 which, when the reversing mechanism 29 is in a reverse position, acts to limit rearward movement of the reaction member 40 of the impact arm 22 away from the water stream.

In this instance, when the reversing mechanism 29 is in the reverse mode, the hooked portion 39 of the reversing arm 33 projects into the rearward path of an extension portion 41 on impact arm 22 and engages that portion at a point where the reaction member 40 has just left the water stream. At this position of the impact arm 22, the arm spring 28 has been compressed to only a very small degree, and, accordingly, the impact arm 22 is at a relatively high energy level when it hits reversing arm 33 during its reverse deflection. This then produces a relatively large impact driving force on the reversing arm 33, and hence the sprinkler body 14, in the reverse direction. Reverse rotation of the sprinkler body 14 then continues until the trip extension 35 engages the trip stop 36 to move the reversing arm to its other stable position and retract the hooked portion 39 out of the path of the impact arm 22 whereupon forward rotation is again initiated.

To arrange the sprinkler 10 for full circle operation, the trip extension 35 can be rotated out of the path of engagement with stops 36 and 37 so it can't engage either of the trip stops 36 or 37 and will therefore rotate continuously.

The basic parts and operation of the sprinkler head 10 as heretofore described are old and well known in the sprinkler art. A fuller explanation is set forth in U.S. Pat. Nos. 4,182,494 and 3,977,610, the teachings of which are incorporated herein by reference.

Figure 6:
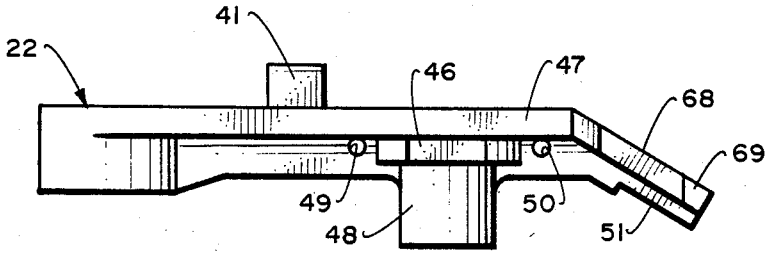
FIG. 6 is a detail view of a portion of the arm of FIG. 5 taken along lines VI—VI thereof.
Figure 4:
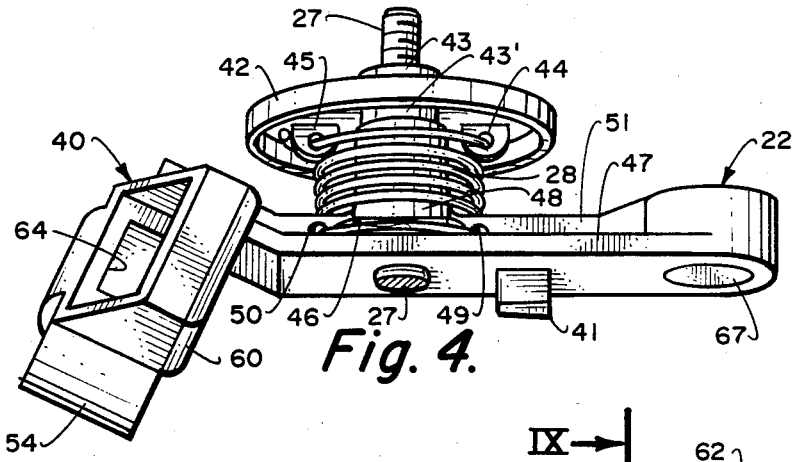
FIG. 4 is a detailed perspective view of the underside of a portion of the head of FIG. 1.

Referring once again to FIG. 1, it can be seen that a spring retainer 42 is provided on fulcrum pin 27 disposed over and retaining spring 28 in position. A nut 43 is threaded on pin 27 holding retainer 42 in position. As particularly contemplated in the present invention, spring retaining means are provided for retaining spring 28 in position on sprinkler head 10 so that it functions properly. As seen in FIG. 4, such means includes a pair of spaced apertured tabs 44,45 on the underside of retainer 42. Such means further includes a raised boss 46 (FIGS. 5 and 6) on the main elongated body portion 47 of arm 22. Boss 46 encircles the bottom or lower end of apertured bearing portion 48 through which pivot pin 27 extends. Such means further includes spaced apertures 49,50 passing through an upstanding rib 51 on portion 47 on both sides of boss 46. As seen in FIG. 4, the free upper end of spring 28 passes through the holes in tabs 44,45 while the free lower end of spring 28 encircles boss 46 with the terminal end passing through holes 49,50 and secured thereto at the top and bottom as by bending or crimping the free ends. In this manner, the spring 28 is maintained and kept in a desired operative position on arm 22. Nut 43' on threaded shaft or fulcrum pin 27 and nut 43 are used to change the position of retainer 42 with respect to spring 28 and thus vary the resiliency.

Figure 8:
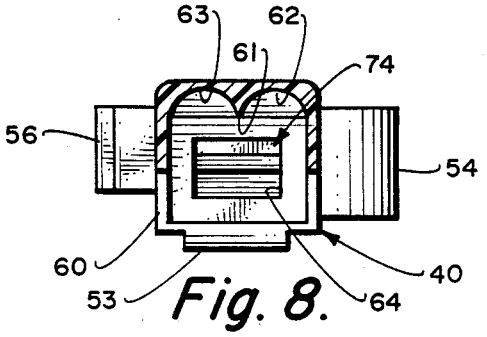
FIG. 8 is a view taken along lines VIII—VIII of FIG. 7.
Figure 9:
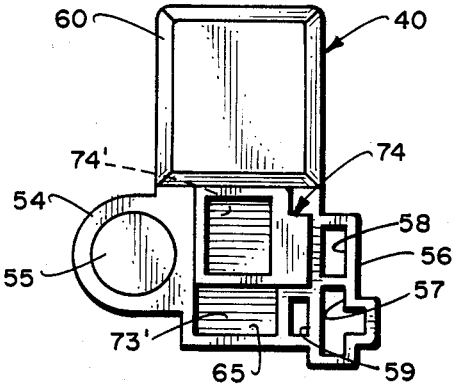
FIG. 9 is a view taken along lines IX—IX of FIG. 5.
Figure 10:
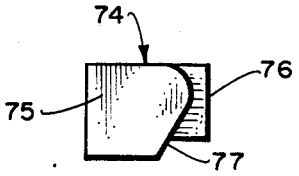
FIG. 10 is a vertical view of the insert alone of FIG. 9.
Figure 11:
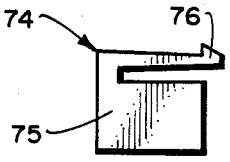
FIG. 11 is another view of the insert of FIG. 10.

Referring again to FIGS. 5 through 7, the arm 22, FIG. 5, may be comprised of two main sections secured by a screw 52. Thus, reaction member 40 (FIG. 7) includes a main body portion 53 having an apertured lower end 54, adapted to receive a removable weight, such as a brass weight 55, therein (see also FIG. 9). An upper mating section 56 includes a T-shaped apertured area 57 and a square shaped apertured area 58. A smaller square shaped apertured area 59 is below area 57. A fluid chamber 60 extends from body portion 53 and is divided within by an upstanding rib 61 (FIG. 8) to provide two side-by-side curved bottom fluid chambers 62,63 in fluid communication with a square-shaped opening 64 in main body portion 53 which is in fluid communication, via internal chambers in body portion 53, with an opening 65 (FIG. 9). It is to be understood that opening 65 is aligned in the path of fluid exiting out of nozzle 19 along discharge axis 20 (FIG. 1) as is well known in the art. Also, as will be discussed further with respect to FIGS. 10 and 11, a removable insert 74 may be insertible in an opening 74' (shown in FIG. 12) to thus selectively provide a fluid channel through reaction member 40 which channel may be varied by varying the angular shape of insert 74.

Figure 7:
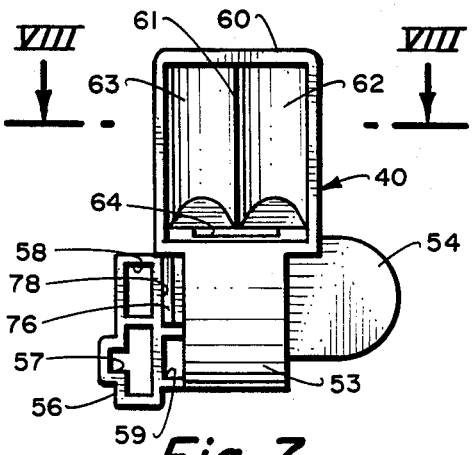
FIG. 7 is a view taken along lines VII—VII of FIG. 6.

Referring again to FIG. 5, arm 22 includes an apertured portion 66 also adapted to receive therein a removable brass weight 67. The other end of arm 22 terminates in a narrow extension arm 68, having an enlarged end 69, and a T-shaped extension arm 70 configured as opening 57 (FIG. 7). Thus, the parts may be of plastic, and snap fit together with arm 69 entering opening 58. Screw 52 can then be threaded between arm end 69 and the walls of opening 58 to securely hold the reaction member 40 on arm 22. The reaction member 40 can of course be easily removed and replaced should it become clogged up, as with dirt or sand, in like manner. The enlarged end 69 wedges in opening 58.

Figure 5:
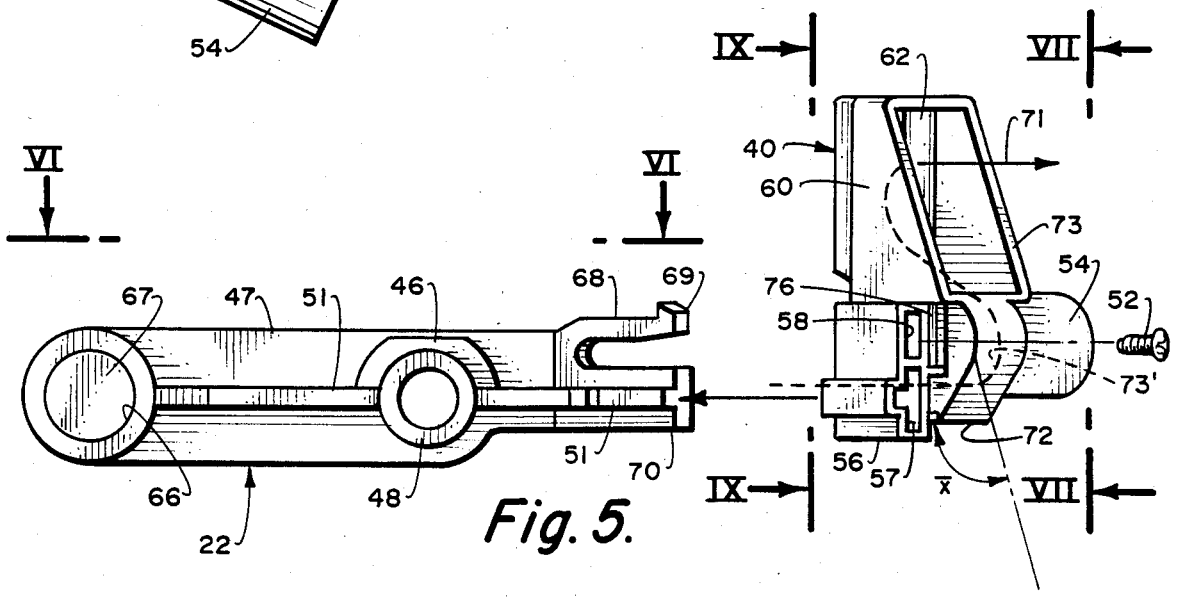
FIG. 5 is an exploded view of the arm alone of the head of FIG. 1.

As seen by arrow 71 in FIG. 5, the entering fluid from nozzle 19 abuts curved inner surface 73' and is discharged out of twin chambers 62,63 in the direction of arrow 71. It is a feature of this invention that angle x, formed by a line passing tangential to the bottom 72 and face 73 of reaction member 40, be between about 105 degrees to 119 degrees.

The relationship of the spring retention heretofore described, and the twin arcuate chambers, results in the elimination of back splash, side splash and overspraying. By making the lower arm 22 of separable parts, the reaction member 40 only may be replaced without the need for dismantling the entire sprinkler assembly. The fluid entering reaction member 40 from nozzle 19 follows the dotted line path shown in FIG. 5 exiting thereout in the direction of arrow 71. The angular relationship of the shape of the reaction member 40, as defined by angle x, along with the continual proper orientation provided on spring 28, results in efficient operation of the sprinkler without side or back splash. The use of angular flow of fluid to operate a sprinkler is described in detail in U.S. Pat. No. 4,182,494. However, in the arrangement disclosed herein, in order to operate arm 22 efficiently, the angle through which each of the internals portions of reaction member 40 deflects the stream of water can be between about 105 to 119 degrees, an angle of about 116 degrees being preferred.

This prevents the arm from locking or sticking in the water stream.

The unique curved doubled water chambers 62,63 ease the water out providing a smooth transition eliminating all side splash and the sprinkle disperses water more evenly and with less turbulence than prior known devices. The spring retainer 42 may be stainless steel and may be used to adjust the arm spring tension via nuts 43,43' (the latter being below retainer 42 and above bearing portion 48 on pin 27). The reversing mechanism may be adjusted, as is well known in the art, to operate between predetermined degrees, e.g., 20 to 340 degrees.

Stainless steel and brass may be used throughout except for the plastic portions heretofore described which may be high impact A.B.S. or other suitable plastic, such as a polypropylene plastic.

The arcuate interiors of the curved chambers 62,63 on each side of rib or vane 61 gives a smooth round flow output. They enable the reaction member 22 to absorb more energy to surface area to load the spring up. If the spring 28, however, is not kept perfectly straight and rubs on any parts, it will draw quite a bit of the load that can be put on the spring so that, when it returns to impact to move the sprinkler head, the advantages of the split chambers are lost. Thus, the boss 46 keeps the spring 28 centered, prevents friction from acting thereon and thus prevents spring 28 from jamming up and these features combine to provide a sprinkler head which can operate with up to 15 pounds less water pressure than known prior art sprinklers. In fact, it can operate with as little as 2 and ½ pounds of pressure. Although arm 22 has been described as two separable pieces, which enables a clogged or broken reaction portion to be quickly and easily replaced, obviously it can be one unitary piece and longer, if desired, with screw 24 used to limit the nozzle range and diffuse the water as is well known in the sprinkler art.

Figure 12:
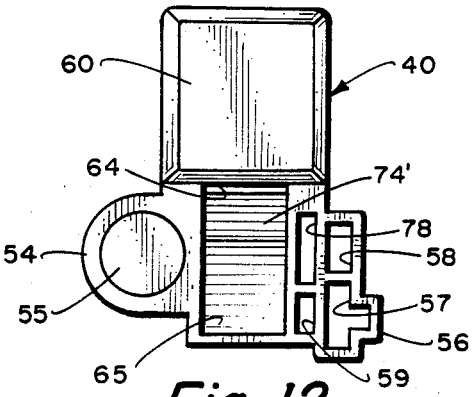
FIG. 12 is a view similar to FIG. 9 with the insert removed.

The counterweights 55 and 67 can of course be eliminated. No glueing of parts of the arm 22 is necessary. As shown in FIGS. 9 to 12 and heretofore described, a removable plastic insert 74 having a main body portion 75 (FIG. 11) with a resilient extension portion 76 and an arcuate outer surface 77 may be inserted into a chamber in portion 53 closing off the chamber save for forming chamber 65 communicating with chamber 64. Leg 76 enters slot 78 in member 53 (FIG. 12). This saves costs since insert 74 may be hollow as a solid mass is not necessary and is configured internally to provided the desired curvature of fluid flow out opening 64.

The split channels bring water into the medium area of the exit stream and thus eliminate side splash and disperse the water stream evenly throughout. Single chambered prior art units merely provide a water stream having a main far water throw and a short water throw and result in overwatering at one end and dehydration at the other. Increasing water flow only increases the long and short throws proportionately.

The counterweights 55 and 67 slow the arm down under higher pressure enabling use of nozzles of different sizes. The weights can be used in either the elongated arm portion or the reaction member, or both. They slow down the arm movement so the movement of the impact head is slowed.

It can be seen that there is disclosed an improved sprinkler head which disperses water evenly with better fluid flow and operates at less pressure than known prior art devices.

In retrospect it is seen that the device of this invention which features the split spoon with the entry angle of between 103 and 119 degrees, and the spring retaining boss gives rise to a significantly improved sprinkler head capable of operating at about 2.5 psi as compared to the 15 psi pressure required of the prior art sprinkler heads. In times of low water levels and low pressure this can mean the difference between survival and disaster for many farmers, home lawn keepers and golf courses.

It is also seen that the spoon disclosed herein can also be used wth any existing style arm but not to as much advantage as when combined with the arm of this invention. The improved arm and the split spoon comprising the total invention herein may be made of brass, bronze, stainless steel, aluminum or plastic such as polycarbonate or ABS as may be desired.

The advantages of the oscillating sprinkler of this invention include less distortion of the range stream, more even and smoother drive from one end to the other as it makes its traverse, smaller time frame to replace parts due to erosion or breakage.

While the spoon herein has been shown as being attached by screws, obviously pins, spring retainers or any other mechanical means suitable may be employed.

While the spoon of this invention can be utilized separately with prior art arms, and prior art arms can be utilized with any spoon, the ultimate benefits arise to the user combining the two elements into the improved sprinkler system of this invention.

Since certain changes may be made in the above apparatus and method without departing from the scope of the invention herein involved, it is intended that all matter contained in the above description and shown in the accompanying drawings shall be interpreted as illustrative and not in a limiting sense.

I claim:

1. In a sprinkler head having a body, a sprinkler nozzle on the body through which water is ejected from the sprinkler head in a forward direction and an oscillating spring biased impact arm having a reaction member intercepting the water ejected by the nozzle, then biased to the rest position to impact the body and effect rotation of the body through a preselected arc by small angular increments, a retaining member fixedly mounted to said body retaining a helical spring between said retaining member and said impact arm for biasing the same, the improvement which comprises:

a boss on said arm, said spring being directly connected at one end to said retaining member and at the other end to said arm encircling said boss, and a reaction member having a rearwardly facing arcuate deflector surface for diverting water issuing from the nozzle through a first angle of between about 105 and 119 degrees laterally and rearwardly from said forward direction, to a spoon section having a pair of vertically side by side forwardly facing arcuate concave elongated deflector channels separated by an upstanding horizontal vein for receiving diverted water from said rearwardly facing deflector surface and for splitting the diverted water into two parallel streams, said spoon section also having a portion disposed a substantialy distance rearwardly of said rearwardly facing deflector surface for redirecting the parallel streams of water forwardly to a direction substantially parallel with said forward direction, whereby water issuing from the nozzle is substantially confined to the preselected arc through which the sprinkler is rotated, and wherein said sprinkler is operative at pressures of less than 15 p.s.i.

2. In the head of claim 1 wherein said first angle is about 116 degrees.

3. In the head of claim 1 wherein said retaining member includes a pair of downwardly extending spaced apertured lugs, said spring having one end extending through the apertures in said lugs and retained therein.

4. In the head of claim 3 wherein said arm includes an upstanding bearing member having a pivot pin extending therethrough with said arm rotatable about said pin, said retaining member being fixedly secured to said pin and adjustable thereon.

5. In the head of claim 4 wherein said boss is an enlarged portion of said arm surrounding a portion of the lower end of said bearing member.

6. In the head of claim 5 wherein said arm further includes a raised elongated rib extending axially along substantially the middle of said arm and the lower end of said spring is secured to spaced apertures in said rib on each side of said bearing member.

7. In the head of claim 1 wherein the reaction member is removable from the remaining portion of said arm.

8. In the head of claim 1 including a removable weight mounted in a cavity at one end of said arm.

9. In the head of claim 1 including a removable weight mounted in a cavity in said reaction member.

10. In a sprinkler head having a body, a sprinkler nozzle on the body through which water is ejected from the sprinkler head in a forward direction and an oscillating spring biased impact arm having a reaction member intercepting the water ejected by the nozzle, then biased to the rest position to impact the body and effect rotation of the body through a preselected arc by small angular increments, a retaining member fixedly mounted to said body retaining a helical spring between said retaining member and said impact arm for baising the same, the improvement which comprises:

said reaction member being removable from the remaining portion of said arm, wherein said remaining portion of said arm includes extension means extending therefrom for connection to said reaction member and said reaction member includes a main body portion having a fluid chamber extending angularly through said main body portion fluidly communicating with a fluid deflection chamber, extending from said main body portion for receiving a weight therein, and aperture means in said main body portion adapted to receive therein said extension means to thereby selectively lock said reaction member to the remaining portion of said arm, the angularly extending fluid chamber having a first deflection angle of less then 120 degrees and wherein the deflection chamber includes a centrally disposed horizontal upstanding vein separating a pair of vertically stacked arcuate deflection channels adapted to split incoming fluid from the angularly extending fluid chamber into two parallel streams.

11. In the head of claim 10 including removable insert means in said main body portion disposed in said fluid chamber therethrough for closing off a portion of said fluid chamber.

12. The sprinkler head of claim 10 wherein said first deflection angle is about 116 degrees.

* * * * *